US005292231A

United States Patent [19]

Lauzeille

[11] Patent Number: 5,292,231

[45] Date of Patent: Mar. 8, 1994

[54] TURBOMACHINE BLADE MADE OF COMPOSITE MATERIAL

[75] Inventor: Gérard Lauzeille, Marles en Brie, France

[73] Assignee: Societe Nationale d'Etude et de Construction de Moteurs d'Aviation "S.N.E.C.M.A.", Paris, France

[21] Appl. No.: 999,359

[22] Filed: Dec. 31, 1992

[30] Foreign Application Priority Data

Dec. 31, 1991 [FR] France ..... 91 16358

[51] Int. Cl.[5] ..... F01D 5/28

[52] U.S. Cl. ..... 416/229 A; 416/230

[58] Field of Search ..... 416/229 R, 229 A, 230, 416/223 A

[56] References Cited

U.S. PATENT DOCUMENTS

| | | | |
|---|---|---|---|
| 3,737,250 | 6/1973 | Pilpel et al. . | |
| 4,037,990 | 7/1977 | Harris . | |
| 4,040,770 | 8/1977 | Carlson | 416/230 |
| 4,098,559 | 7/1978 | Price | 416/230 |
| 4,343,593 | 8/1982 | Harris | 416/229 A |
| 5,149,319 | 9/1992 | Glowacki | 416/230 |
| 5,181,829 | 1/1992 | Pancotti | 416/230 |

*Primary Examiner*—John T. Kwon

*Attorney, Agent, or Firm*—Oblon, Spivak, McClelland, Maier & Neustadt

[57] ABSTRACT

A turbomachine blade made of a fiber-reinforced composite material includes an aerodynamic portion and a fixing root portion, the latter being formed by at least two distinct arms which branch and spread without discontinuity from the aerodynamic portion and which are each formed into a loop which completely surrounds a separation core.

3 Claims, 2 Drawing Sheets

TURBOMACHINE BLADE MADE OF COMPOSITE MATERIAL

BACKGROUND OF THE INVENTION

1. Field of the Invention

The invention relates to turbomachine blades, such as those of a compressor or fan, which are made of a fiber-reinforced composite material. Such blades are geometrically simplified by the absence of platforms and struts, and have the advantage of substantially reducing the mass of the bladed rotor assembly, which is very important in the case of large diameter turbomachines.

2. Discussion of the Background

However, one difficulty which arises in the manufacture of turbomachine blades of composite materials is that, in spite of having high tensile strength, the fibers used in the reinforcement of the material are fragile and weak under compression or shear. Problems then arise with the transfer of loads from the blades, which are of composite material, to the rotor disc, which is metallic, without damage to the fibers.

The root of this type of blade is usually in the form of a dovetail or a bulb, and the fibers of the aerodynamic part of the blade extend into the root, the fibers moving apart within the root. It is necessary, in order to obtain a good resistance to centrifugal force, to ensure the integrity of the composite material of the blade in this area of the root.

SUMMARY OF THE INVENTION

With this in mind, according to the present invention there is provided a turbomachine blade made of fiber-reinforced composite material, said blade comprising an aerodynamic portion and a root portion for fixing said blade on a rotary disc of the turbomachine, said root portion being formed by at least two distinct arms which branch and spread out without any discontinuity from said aerodynamic portion, and at least two separation cores, each of said arms being formed into a loop which completely surrounds a respective one of said separation cores.

Preferably the blade further comprises an outer shell which surrounds the root portion of the blade and from which the aerodynamic portion projects. The shell may be made of metal.

Preferably a space is defined between the outer faces of the root portion of the blade and the inner face of the outer shell, the space being filled with a suitable material such as an elastomer.

The separation cores are preferably separate from the outer shell.

In a preferred embodiment the root Portion is formed by two arms and three separation cores, each of the two arms forming a loop which turns inwardly towards the other and is closed around a respective one of said cores, said two loops being in mutual contact and defining, together with the portions of said arms diverging from said aerodynamic portion of said blade, a cavity containing the third core.

In this case the end portion of each arm may extend along the portion thereof which diverges from the aerodynamic portion of the blade, and the third core is preferably completely surrounded by said end portions of the arms.

The main advantage of the blades in accordance with the invention lies in obtaining excellent resistance to centrifugal stresses, and in the ability to use the blades for the large diameter rotors which are used in some turbomachines.

Further features and advantages of the invention may become apparent from the following description of two preferred embodiments, given by way of example, with reference to the accompanying drawings.

DESCRIPTION OF THE PREFERRED EMBODIMENTS

Figure 1:
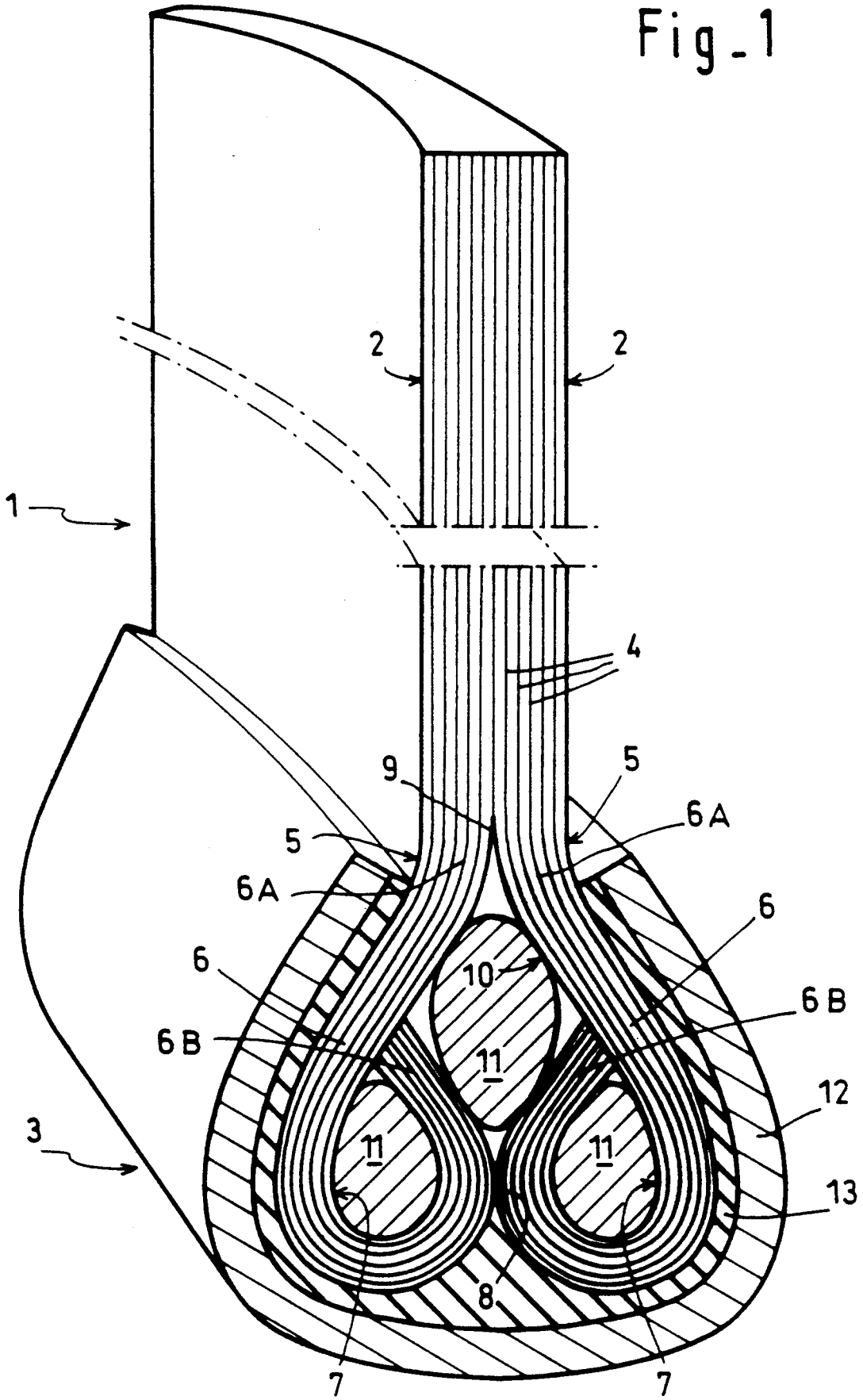
FIG. 1 is a diagrammatic perspective and cross-sectional view of a first embodiment of the blade in accordance with the invention.

The turbomachine blade shown in FIG. 1 comprises an aerodynamic portion 1, the outer faces 2 of which form the intrados and extrados faces of the blade, and a root portion 3 for securing the blade to the periphery of a rotatably mounted support disc (not shown).

The aerodynamic portion is made of a fiber-reinforced composite material, such as a resin containing fibers of glass, carbon, or the like, by successive applications of sheets 4 of the said material one on top of another. It merges with the root portion 3 in an area which can be denoted as being stem 5, from which it branches into two arms 6 (although there may be more in other examples) which extend into and form part of the root portion.

The arms 6, which are distinct, separate and initially diverge from the stem 5, and then, in the example shown, each arm 6 turns inwards into the root and back towards itself so as to form a closed loop 7. As shown, the two loops 7 are in mutual contact in the central area 8 of the root. Each arm has a first portion 6A, which starts from the stem 5, and an end portion 6B which abuts the inner face of the first portion to close the loop 7. Between the area 8 and the area 9 at which the arms 6 separate, a cavity 10, similar to the loops 7, is defined by the inner faces of the first portions 6A of the arms and the outer faces of the end portions 6B.

Within each loop 7 and the cavity 10 is a core 11 made of resin, the cores substantially completely filling the said loops 7 and cavity 10.

The root portion thus formed by the arms 6 and the cores 11 has a cross-section resembling that of a dovetail, and is introduced by an axial sliding movement into a metal shell 12 which provides a clearance space between the arms 6 and the shell. The latter surrounds the root portion of the blade as far as the stem 5, at which point the aerodynamic portion 1 of the blade extends from the shell 12.

A suitable filling material 13 fills in the clearance space formed between the inner face of the shell and the outer faces of the arms 6. This material 13 is preferably an elastomeric material, and is introduced into the space by injection.

Figure 2:
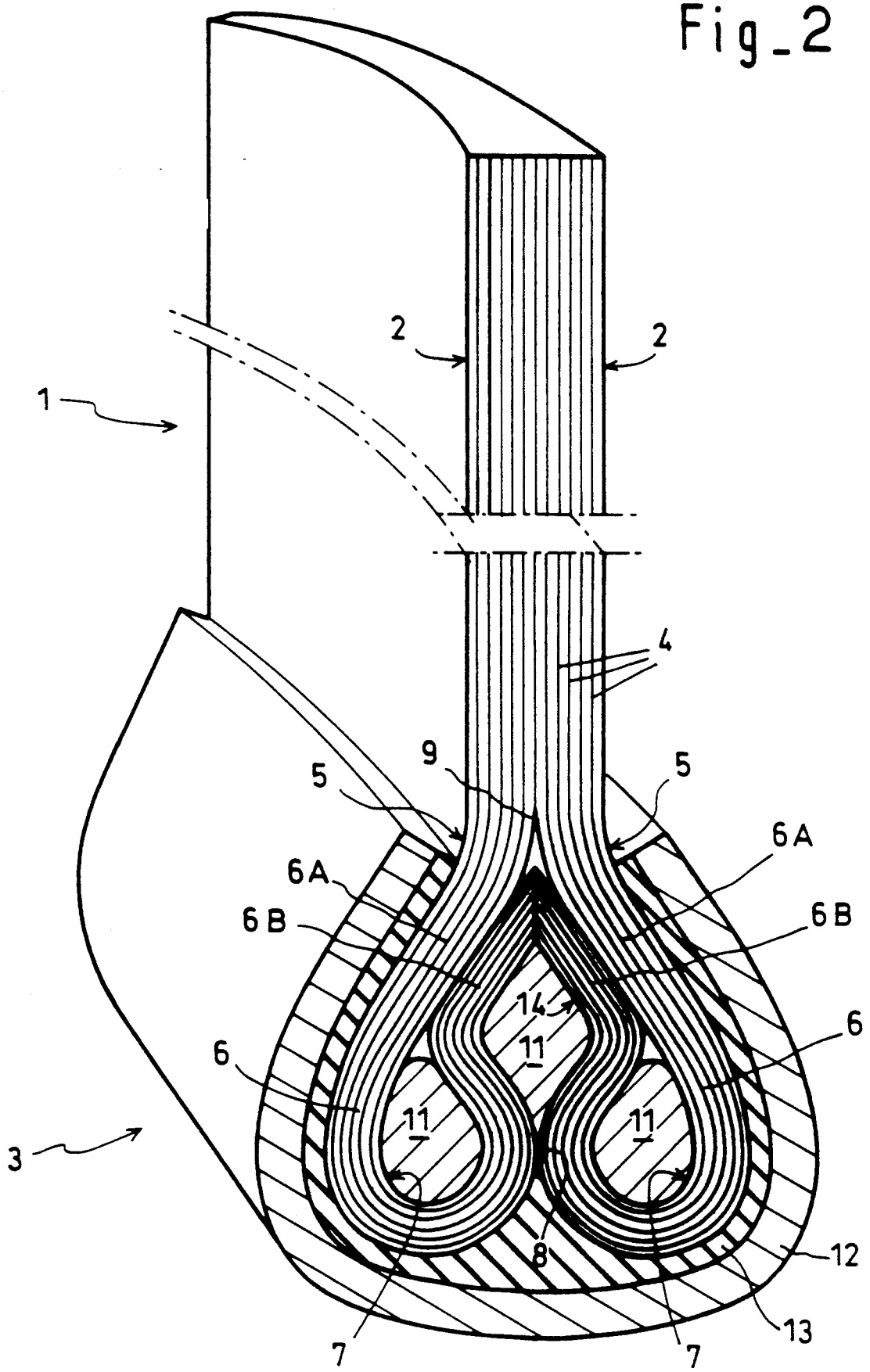
FIG. 2 is a view similar to that of FIG. 1, but showing a second embodiment.

The embodiment shown in FIG. 2 is similar to that of FIG. 1, differing only by the fact that the end portions 6B of the arms 6 are extended along the first portions 6A to meet each other in the separation region 9. Thus, the cavity 10 is replaced by a cavity 14 defined solely by the end portions 6B of the arms 6 and by the parts of the arms which extend between the loop contact region 8 and the end portions 6B. A core 11 fills the cavity 14.

The connection of the various elements of the roots of the blades shown may be effected in a variety of ways, such as:

applying a film of glue between the arms 6 and the cores 11, the glue being compatible with the polymerization cycle of the resin.

shaping the laminated sheets of composite material, placing prepolymerized cores in position, and then curing the assembly;

shaping the laminated sheets of composite material, placing the cores in position, and then curing the assembly;

shaping and polymerizing the laminated sheets of composite material, after setting already cured cores in place.

The formation of the loops 7 and the putting in place of the cores 11 result in the formation of locking wedges which have the effect of providing outstanding resistance to centrifugal stresses.

The cores 11 may be made of a composite material comprising fibers embedded in resin matrix, or alternatively, they may be made of metal.

The elastomeric layer 13 injected between the shell 12 and the arms 6 has the effect of filtering vibrations and attenuating or suppressing battering, which risks damaging the composite material of the arms 6. This layer may also eliminate the galvanic problems which sometimes occur when sensitive materials, such as carbon fibers, and aluminium cores are used in certain applications.

The lightness of the blades made in accordance with the invention contributes to the limiting the magnitude of the centrifugal stresses to which they are subjected during use. Furthermore, their excellent resistance to these centrifugal stresses makes is possible to use them for the blading of rotor discs in turbomachines of large diameters.

Obviously, numerous modifications and variations of the present invention are possible in light of the above teachings. It is therefore to be understood that within the scope of the appended claims, the invention may be practiced otherwise than as specifically described herein.

I claim:

1. A turbomachine blade made of fiber-reinforced composite material, said blade comprising:

an aerodynamic portion and a root portion for fixing said blade on a rotary disc of the turbomachine, said root portion being formed by at least two distinct arms which branch and spread out without any discontinuity from said aerodynamic portion, and at least two separation cores, each of said arms being formed into a loop which completely surrounds a respective one of said separation cores wherein said root portion is formed by two of said arms and three of said separation cores, each of said two arms forming a loop which turns inwardly towards the other and is closed around a respective one of said cores, said two loops being in mutual contact and defining, together with the portions of said arms diverging from said aerodynamic portion of said blade, a cavity containing the third core.

2. A blade according to claim 1, wherein the end portion of each of said arms extends along said portion thereof diverging from said aerodynamic portion of said blade.

3. A blade according to claim 2, wherein said third core is completely surrounded by said end portions of said arms.

* * * * *